US007538740B2

(12) United States Patent
Korisch et al.

(10) Patent No.: US 7,538,740 B2
(45) Date of Patent: May 26, 2009

(54) MULTIPLE-ELEMENT ANTENNA ARRAY FOR COMMUNICATION NETWORK

(75) Inventors: Ilya Alexander Korisch, New Brunswick, NJ (US); Robert Atmaram Soni, Morris Plains, NJ (US); Kam H. Wu, Randolph, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 315 days.

(21) Appl. No.: 11/368,551

(22) Filed: Mar. 6, 2006

(65) Prior Publication Data

US 2007/0205955 A1 Sep. 6, 2007

(51) Int. Cl.
*H01Q 21/00* (2006.01)

(52) U.S. Cl. ..... 343/844

(58) Field of Classification Search ..... 343/844, 343/853, 797, 702, 700 MS; 455/561, 562.1, 455/575.7

See application file for complete search history.

(56) References Cited

U.S. PATENT DOCUMENTS 5,952,983 A 9/1999 Dearnley et al.
6,067,053 A * 5/2000 Runyon et al. ..... 343/797
6,314,305 B1 11/2001 Solondz et al.
6,640,111 B1 * 10/2003 Shapira ..... 455/562.1
6,760,603 B1 7/2004 Scherzer et al.
6,900,775 B2 * 5/2005 Shapira ..... 343/844
6,920,192 B1 7/2005 Laroia et al.
6,937,206 B2 8/2005 Baliarda et al.
2003/0073463 A1 * 4/2003 Shapira ..... 455/562
2006/0052065 A1 * 3/2006 Argaman et al. ..... 455/101
2007/0285312 A1 * 12/2007 Gao et al. ..... 342/367

* cited by examiner

*Primary Examiner*—Huedung Mancuso

(57) ABSTRACT

An antenna array includes four closely spaced, linearly arranged antenna columns. At least two of the columns, e.g., the center two columns, are dual-polarized. Spacing between neighboring columns is about ½λ, where λ is the free space wavelength at the network carrier frequency. Each column includes a first vertical linear array of radiating elements or groups of elements (sub-arrays) connected to a port. The dual-polarized columns each further include a second linear array of radiating elements oriented at a different polarization than the first array. (For example, horizontal/vertical or slant 45°.) Array ports are connected with four RF feed cables using duplexers in such a way so as to provide two different antenna configurations for forward link and reverse link frequencies, namely, a four-column closely spaced beam-forming array at the forward link and a two-column dual-polarized array at the reverse link for 4-branch diversity reception.

19 Claims, 7 Drawing Sheets

MULTIPLE-ELEMENT ANTENNA ARRAY FOR COMMUNICATION NETWORK

FIELD OF THE INVENTION

The present invention relates to radio-frequency (RF) communications and, more particularly, to radio wave antennas.

BACKGROUND OF THE INVENTION

Various advances in commercial wireless and networking technologies have enabled the support of voice and high-speed data services to wireless unit end users, e.g., those using mobile phones, wireless personal digital assistants (PDA's), or the like. As third generation wireless packet data networks have evolved to support a wide range of multimedia and other high-speed data services, packet data voice services have become a viable alternative or replacement for traditional circuit switched voice communications. Because of the increased demand for wireless communications generally, and especially in terms of high-speed data transfer, service providers have sought to increase network capacity. However, supporting the need for increased capacity can negatively affect quality of service, particularly if no special attempt is made to address this need. For example, signal distortion resulting from co-channel interference may increase as channel load increases.

In a simple wireless system, a transceiver for receiving and transmitting RF signals is provided with a single transmit/receive antenna element, and possibly a second antenna element to provide reception diversity. To improve quality and/or increase capacity in a wireless network, more complex antenna systems may be used instead, e.g., an antenna array. An antenna array is a group of spatially distributed antennas/RF sensors, wherein the output of the antenna array is obtained by properly combining each antenna output by way of a weighting network, a beamforming network, or the like. An antenna array can reduce signal interference, increase effective received signal energy, and/or boost the signal-to-interference-plus-noise ratio ("SINR") according to the signal arrival angles and/or directions of arrival. One type of antenna array is the adaptive antenna array or so-called "smart antenna." An adaptive antenna array is an antenna array that continuously adjusts its own pattern by means of feedback control. Typical adaptive antenna arrays have the same architecture for the forward link and reverse link channels. With a limitation on the number of RF feed cables per base station, this results in a maximum of four co-polarized columns, two dual-polarized columns, or three columns of one polarization and one column of the other polarization. This leads to a suboptimal performance in suburban or light urban environments across the reverse link and/or the forward link, depending on the configuration choice.

To explain further, in modern wireless systems one of the most severe limitations imposed on adaptive antenna arrays is the number of RF feed cables per base station. Since tower top transceiver electronics are uncommon, antennas are typically connected to the base station electronics (e.g., housed at ground level in a building or cabinet) by way of large-diameter, low-loss RF feed cables. The cables impose significant weight and wind loading on the base station tower, and their maximum number is typically restricted to 4 per sector or 12 per cell. (A cell is a geographic area served by a base station, and a sector is a portion or subsection of that geographic area, e.g., a 60° or 120° "slice" of a cell.) Base station architectures are typically designed accordingly, to support a maximum of 12 cables per cell. Under this limitation, current adaptive antenna arrays typically have one of the following three architectures: a 4-column, single polarization array; a 2-column, dual polarization array; or a 4-column array with three columns at one polarization and a fourth column of orthogonal polarization. Antenna configuration remains the same for both uplink and downlink.

Each of the three array configurations has certain disadvantages in suburban or light urban environments. A 4-column, single polarization array provides the highest possible gain over the forward link (e.g., the RF channel for transmissions from base station to wireless unit), with either fixed beamforming or a per-user steered beam solution. On the reverse link, however, due to the high degree of correlation between signals received at four closely spaced antennas, only aperture gain is available. Diversity reception gain is very small or nonexistent, possibly resulting in a significantly smaller gain over the reverse link when compared to a non-adaptive antenna configuration of the typical cell site, which may have a single antenna column for transmissions and a pair of diverse antenna columns for reception. A 2-column, dual polarization array provides high gain, including both diversity (polarization) and aperture gain over the reverse link, due to uncorrelated signals received at two orthogonally polarized pairs of antennas. Over the forward link, a combination of beamforming and transmission diversity is used, however, which may result in gain values lower than in a 4-column, single polarization array as other forms of diversity exist in modern cellular systems. A 4-column, "3/1" polarization array is a compromise, providing performance similar to a 2-column, dual polarization array.

SUMMARY OF THE INVENTION

An embodiment of an antenna array system useful for "3-G" (third generation) and similar wireless communication protocols such as UMTS (Universal Mobile Telecommunications System) and 1x-EVDO (Evolution Data Optimized or Evolution Data Only), among others, includes a plurality of spaced-apart antennas, e.g., antenna columns. A first group of the antennas is configured for transmission beamforming over a first bandwidth, e.g., a forward link. By "group," it is meant two or more of the plurality of antennas. A second group of the antennas is configured for simultaneous diversity reception over a second bandwidth, e.g., a reverse link. The first and second groups are at least partly co-extensive, by which it is meant that one or more of the plurality of antennas are common to both groups. In other words, at least one of the antennas is used for both transmission and reception.

In another embodiment, the antenna array system includes four spaced-apart antennas. At least two of the antennas are dual-polarized antennas. The other antennas are configured as single-polarized antennas. The antenna array may be used for forward link beam forming (directional reception and transmission) over all four of the antennas at a first polarization, and additionally for diversity reception at the dual-polarized antennas at the first polarization and a second polarization. Thus, the antenna array system provides a four-antenna, single-polarized array for forward link beamforming and a two-antenna, dual-polarized array for reverse link 4-branch diversity reception simultaneously.

Collectively, the antennas have at least six ports, e.g., two each for the dual-polarized antennas and one active port for each of the single-polarized antennas. In another embodiment, a duplexer unit is connected to one or more of the antennas. (By "duplexer unit" it is meant one or more duplexer circuits, which may be housed together or separately.) The duplexer unit reduces the number of RF feed cable outlets of the antenna array from six to four, enabling the antenna array to be connected to a base station unit (e.g., base station controller or other electronics) by way of four RF feed cables. If the system includes more than four antennas in the first group, the duplexer unit may be used to reduce the number of feed cable outlets to no more than the number of antennas in the first group.

In another embodiment, the antenna array system comprises four closely spaced, linearly or circularly arranged, dual-polarized antennas. Spacing between neighboring antennas is about ½λ, where λ is the free space wavelength at a designated carrier frequency. Each antenna is a vertical linear array of dual-polarized radiating elements or groups of elements (sub-arrays), having two independent ports. In other words, each antenna includes a first array of radiating elements oriented at one polarization (e.g., vertical/horizontal, or +45°/−45° ("slant 45°")) and connected to a first port, and a second array of radiating elements oriented at another polarization and connected to a second port. This makes for a total number of eight antenna ports for the array. Array ports are connected with four RF feed cables using duplexers in such a way so as to provide two different antenna configurations for forward link and reverse link frequencies, namely, a four-antenna closely spaced beam-forming array at the forward link and a two-antenna dual-polarized array at the reverse link for 4-branch diversity reception.

In another embodiment, the four antennas are linearly arranged. The two center antennas are dual-polarized antennas for both transmission and diversity reception. The outer two antennas are configured for single-polarized use in beam-forming transmissions. Thus, the outer antennas may be either single-polarized antennas (e.g., an antenna column having an array of radiating elements each oriented at a selected polarization), or dual-polarized antennas where one of the arrays of radiating elements is terminated. This might be useful for mitigating signal pattern asymmetry.

In another embodiment, at least one of the antennas in the second group is spaced apart from the first group and the other antennas in the second group, by a distance adapted for spatial diversity reception of signals over the reverse link. In other words, the second group includes one or more antennas co-extensive with the first group, and one or more additional antennas spaced apart by a distance suitable for spatial diversity reception. The distance is chosen based on the environment in which the antenna system is used, for achieving acceptable diversity reception performance.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
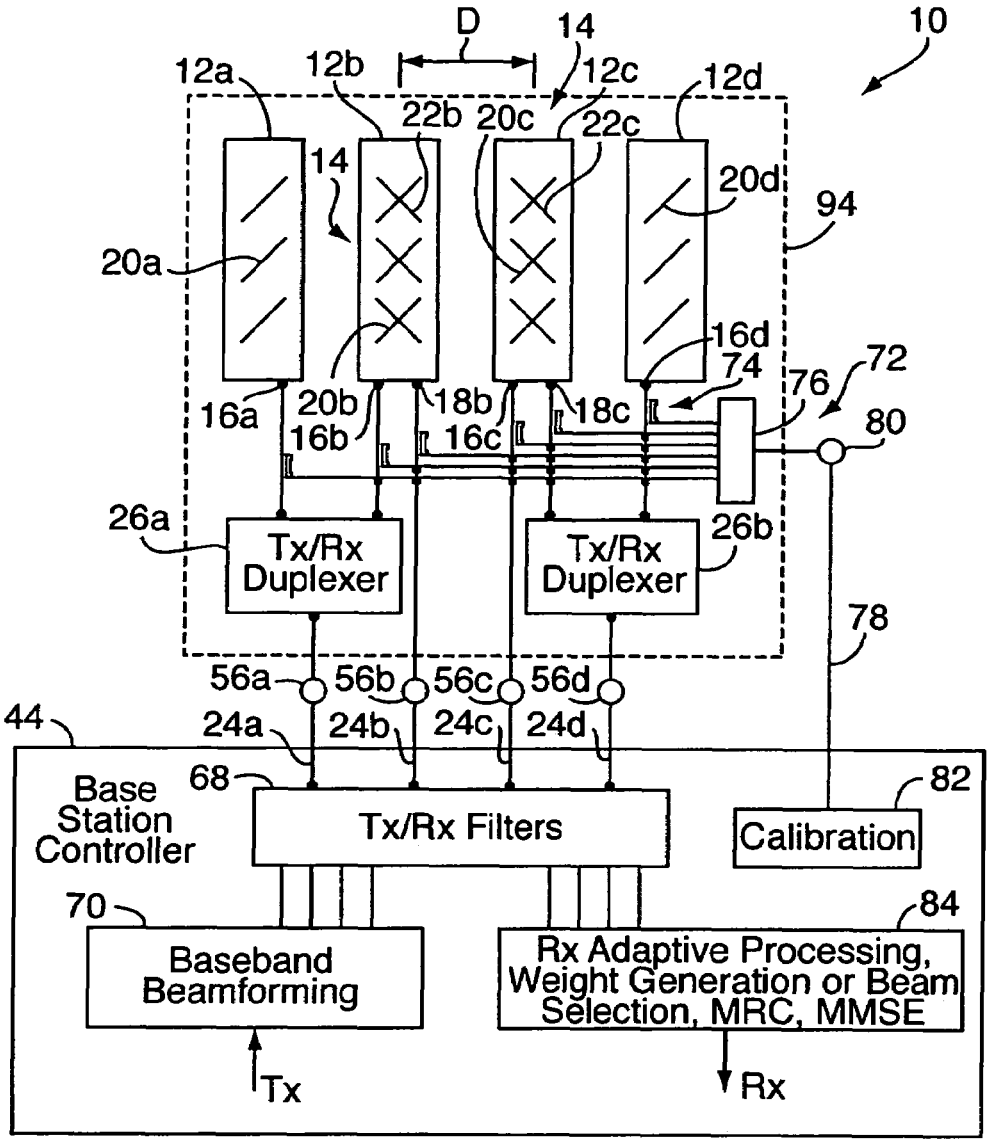
FIG. 1 is a schematic diagram of an antenna array system according to an embodiment of the present invention.

With reference to FIGS. 1-4, an embodiment of the present invention relates to an antenna array system 10 for transmitting and receiving radio-frequency (RF) signals in a wireless communication network. The system 10 includes four linearly arranged, spaced-apart antennas 12*a*-12*d*. The antennas may be antenna columns. Two or more of the columns 12*b*, 12*c* may be dual-polarized antenna columns. Each dual-polarized antenna column 12*b*, 12*c* is a vertical linear array 14 of dual-polarized radiating elements or groups of elements (sub-arrays) having two independent ports 16*b*, 18*b* or 16*c*, 18*c*. In other words antenna column 12*b* includes a first array 20*b* of radiating elements oriented at a first polarization and connected to a first port 18*b*, and a second array 22*b* of radiating elements oriented at a second polarization and connected to a second port 16*b*. (Note that ports 16*b*, 18*b* are shown "reversed"—port 18*b* is connected to array 20*b*, for both transmission and reception of signals, while port 16*b* is connected to array 22*b*, for reception only.) Antenna column 12*c* includes a first array 20*c* of radiating elements oriented at a first polarization and connected to a first port 16*c*, and a second array 22*c* of radiating elements oriented at a second polarization and connected to a second port 18*c*. The first and second polarizations may be, for example, vertical/horizontal or slant 45°. The outer two columns 12*a*, 12*d* may each be a single-polarized antenna column having a single array 20*a*, 20*d* of radiating elements connected to a port 16*a*, 16*d*, respectively, and oriented at the first polarization. The six antenna ports 16*a*-16*d*, 18*b*, 18*c* are connected to four RF feed cables 24*a*-24*d* using duplexer circuits 26*a*, 26*b* in such a way so as to provide two different antenna configurations for forward link 28 and reverse link 30 frequencies, namely, a four-column closely spaced beam-forming array at the forward link (the arrays 20*a*-20*d*) and a two-column dual-polarized array (the arrays 20*b*, 20*c*, 22*b*, 22*c*) at the reverse link for 4-branch diversity reception.

As noted above, the antenna array 10 will typically be used for transmitting and receiving RF signals in a wireless communication network, such as a cellular network configured for carrying out wireless communications between various wireless units 40 and one or more fixed base stations 42 across a particular geographic area. The antenna array 10 may be used on different types of such networks, for example, a CDMA-based 1x-EVDO communications network. (1x-EVDO is an implementation of the CDMA2000® "3-G" mobile telecommunications protocol/specification configured for the high-speed wireless transmission of both voice and non-voice data.) The wireless units 40 may include, for example, mobile phones, wireless PDA's, wireless devices with high-speed data transfer capabilities, such as those compliant with "3-G" or "4-G" standards, "WiFi"-equipped computer terminals, and the like. The base station 42 is provided with a base station controller 44, which includes various transceivers and other electronics for radio communications with the wireless units 40. The base station 42 will typically be connected by way of a high-speed land line to a radio network controller and/or mobile switching center (not shown), which coordinates data transfer between the network's various base stations and the rest of the network. For example, the network may further include a core packet data network (e.g., a private IP network and/or the Internet) and/or connectivity to a public switched telephone network.

For conducting wireless communications between the base station 42 and the wireless units 40, the network may utilize a CDMA (code division multiple access) spread-spectrum multiplexing scheme. In CDMA-based networks, transmissions from wireless units to base stations are across a single frequency bandwidth known as the reverse link 30, e.g., a 1.25 MHz bandwidth centered at a first designated frequency. Generally, each wireless unit 40 is allocated the entire bandwidth all the time, with the signals from individual wireless units being differentiated from one another using an encoding scheme. Transmissions from base stations to wireless units are across a similar frequency bandwidth (e.g., 1.25 MHz centered at a second designated frequency) known as the forward link 28. The forward and reverse links may each comprise a number of traffic channels and signaling or control channels, the former primarily for carrying voice data, and the latter primarily for carrying the control, synchronization, and other signals required for implementing CDMA communications. The network may be geographically divided into contiguous cells, each serviced by a base station, and/or into sectors, which are portions of a cell typically serviced by different antennae/receivers supported by a single base station.

As should be appreciated, the antenna array of the present invention may be used for carrying out wireless communications in different types of communication systems, and is particularly well suited for use in FDD (frequency division duplex) communications. FDD is a technique in which one frequency or frequency band is used to transmit and another is used to receive. For example, as described above, CDMA is a type of FDD communications. Thus, the antenna array is not limited for use with one particular type or configuration of communication network or communication protocol implemented thereon, whether it be current, proposed, or developed in the future. For example, the antenna array may be used with 1x-EVDO networks, UMTS networks, OFDMA (orthogonal frequency division multiple access)-based networks, WiMAX systems, LTE systems, EVDO Rev. C, and the like.

Figure 3:
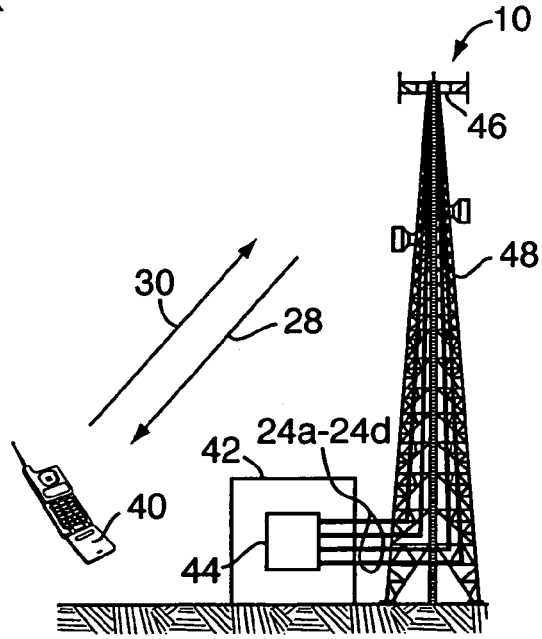
FIG. 3 is a schematic view of a wireless network base station and antenna tower.

As illustrated in FIG. 3, the antenna array 10 will typically be mechanically connected to a platform 46 at the top of a base station tower 48. The platform 46 is coupled to the tower 48, which elevates the antenna array 10 above surrounding buildings and other obstructions. Communication signals are directed between the base station controller 44 and antenna array 10 by way of the RF feed cables 24*a*-24*d*, which are connected to and routed up the tower 48.

Figure 2:
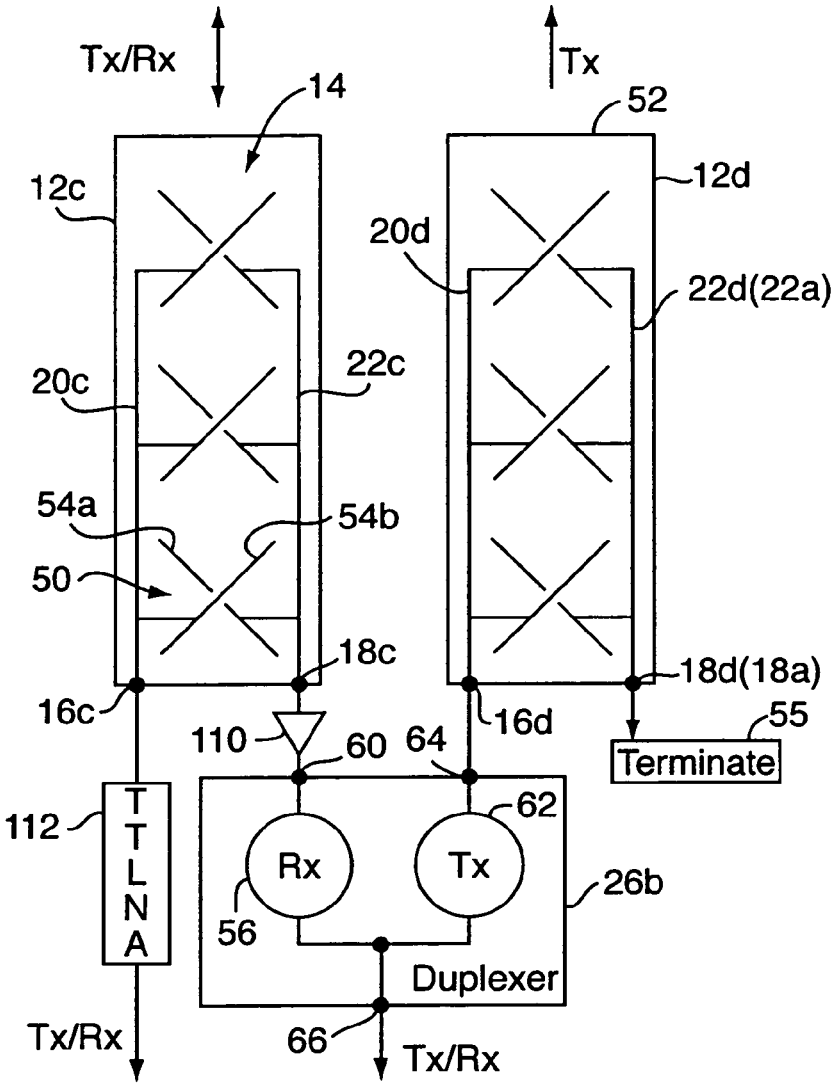
FIG. 2 is a more detailed view of an antenna column and duplexer portion of the antenna array system in FIG. 1.

The dual-polarized antenna columns 12*b*, 12*c* radiate at two orthogonal polarizations such as vertical/horizontal or slant 45°. Each antenna column 12*b*, 12*c* includes a plurality of dual-polarized radiating elements 50 (e.g., crossed dipoles, patches, or the like) oriented appropriately for the particular orthogonal polarizations. An embodiment utilizing a slant 45° arrangement is shown in FIGS. 1 and 2. Similarly oriented radiating elements are electrically connected to form the arrays 20*a*-20*d*, 22*b*, 22*c*, and will typically be connected to a ground plane 52. Dimensions of the radiating elements 50 and the ground plane 52 determine the radiation characteristics, beam width, and the impedance of the radiating elements. The particular number of radiating elements provided may vary, and will typically depend on the gain desired for the antenna column, and/or similar considerations. The radiating elements 50 may be comprised of, e.g., pairs of dipoles 54*a*, 54*b*. The dipoles are crossed and configured with 45° slant angles, or at horizontal/vertical, with respect to the axis of the array. That is, the axes of the dipoles are arranged to be parallel with the polarization sense required. The slant or orientation angles of the dipoles can be varied depending on the desired characteristics of the antenna. The radiating elements 50 transmit and receive RF signals having polarizations according to the orientation of the dipoles, e.g., of +45° and −45°. That is, one dipole in the radiating element receives signals having polarizations of +45° while the other dipole receives signals with polarizations of −45°. The radiating elements can both transmit and receive signals provided the transmitted and received signals are at different frequencies, such as in CDMA or other FDD-type communications.

The antenna columns can be constructed and configured in a number of different manners. Information about the construction and arrangement of radiating elements and antenna columns is widely available in the literature, and is also well known in the art generally.

Instead of single-polarized columns, the outer antenna columns 12*a*, 12*d* may be dual-polarized columns configured to operate in a single-polarized manner. In such a case, the outer antenna columns 12*a*, 12*d* would each further include a second array 22*a*, 22*d* of radiating elements connected to a port 18*a*, 18*d*, respectively, and oriented at the second polarization, but terminated, e.g., using a 50 ohm matched termination or the like 55. This provides dummy element function for the center antenna column arrays 22*b*, 22*c* oriented at the second polarization, for mitigating their radiation pattern asymmetry.

To reduce the number of RF feed cables 24*a*-24*d* required for connecting the antenna array 10 to the base station controller 44, a duplexer unit may be connected to one or more of the antenna columns 12*a*-12*d*. (By "duplexer unit" it is meant one or more duplexer circuits 26*a*, 26*b*, which may be housed together or separately.) For example, as shown in FIG. 3, the two duplexer circuits 26*a*, 26*b* reduce from six to four the number of RF feed cable outlets 56*a*-56*d* of the antenna array, enabling the antenna array 10 to be connected to the base station controller 44 by way of the four RF feed cables 24*a*-24*d*. The outlets 56*a*-56*a* will typically be standard RF feed cable connectors, but it should be understood that the term "outlet" as used herein also encompasses direct connections between the RF feed cables and antenna columns or antenna column leads. The duplexer circuits 26*a*, 26*b* are standard duplexers configured for isolating and combining two frequency bandwidths. For example, as shown schematically in FIG. 2, the duplexer 26*b* may be a passive duplexer including a bandpass filter 58 connected to a terminal or input connector 60 for passing received signals in the reverse link bandwidth, a bandpass filter 62 connected to a terminal or input connector 64 for passing transmitted signals in the forward link bandwidth, and a terminal 66 combining the transmitted and received signals. The duplexers 26*a*, 26*b* may be specifically connected as shown in FIG. 2, noting that for the embodiment shown in FIG. 1 the array of radiating elements 20*d* in the outer antenna column 12*d* is for signal transmission, and that the array of radiating elements 22*c* in the center antenna column 12*c* is for signal reception. As should be appreciated, the array 20*c* of the antenna column 12*c*, for example, is used for both signal transmission and reception, meaning that all four feed cables 24*a*-24*d* in FIG. 1 are used optimally for routing both forward and reverse link signals.

Optionally, instead of using duplexers, the output ports 16*a*-16*d*, 18*b*, 18*c* of the antenna columns may be directly individually connected to the base station controller 44 by way of respective feed cables. Thus, for the configuration in FIG. 1, there would be six feed cables.

The antenna columns 12*a*-12*d* in the antenna array 10 may be generally linearly arranged. By this, it is meant that the antenna columns are arranged one after the other in a co-linear manner within a small percentage due to mechanical/manufacturing tolerances. Neighboring antenna columns 12*a*-12*d* will be spaced apart by a distance "D" measured axis to axis, where D is approximately equal to ½λ (see FIG. 1) and λ is the free space wavelength at or within a certain range of the carrier frequency of the communication network. For example, in an FDD-based network λ may be the free space wavelength at a frequency in a middle point between the forward and reverse link bandwidths. The antenna columns may also be generally circularly arranged. By this, it is meant that the antennas are arranged in a circle within a small percentage due to mechanical/manufacturing tolerances.

The antenna array 10 may be used for forward link beam forming over all four of the antenna columns 12*a*-12*d*, and additionally for diversity reception at the center dual-polarized columns 12*b*, 12*c*. Thus, the antenna array system 10 provides a four-column, single-polarized antenna array 20*a*-20*d* for forward link beamforming and a two-column 12*b*, 12*c*, dual-polarized array 20*b*, 20*c*, 22*b*, 22*c* for reverse link 4-branch diversity reception simultaneously. Beamforming using the four single polarized arrays/columns 20*a*-20*d* may be done at the baseband level, as shown in FIG. 1, in a standard manner. For such a case, in addition to one or more transmission and reception filters 68, the base station controller 44 will include a standard baseband beamforming circuit or controller 70.

For facilitating beamforming, the antenna array system 10 may be provided with a calibration network 72. The calibration network includes six directional couplers 74 and a 6:1 combiner 76. A calibration cable 78 connects a calibration output 80 of the antenna array 10 to a calibration unit 82 of the base station. In operation, signal inputs into the antenna columns are directed onto the calibration cable 78 by way of the directional couplers 74 and combiner 76. The calibration unit 82 uses this signal to calibrate out random phase differences introduced by the antenna feed cables, in a standard manner as known in the art. This is only one possible embodiment of a calibration system suitable for the antenna array system of the present invention, using directional couplers, a combiner, and a single calibration cable feeding into the calibration unit 82. In general, a calibration system samples the signal at each of the antenna columns and provides the information about its magnitude and phase so that the beamforming system can correct for the differences in magnitude and/or phase.

The two central dual polarized columns 12*b*, 12*c* are used for four-branch receiver diversity reception, and may also be used for determining the DOA (direction of arrival) to be used in forward link beamforming in case of beam steering, or for choosing the optimal beam or beams in case of fixed forward link beamforming, in a standard manner. For these functions, the base station controller 44 is provided with an appropriately configured diversity receiver or other receiver module/electronics 84. As indicated in FIG. 1, the receiver module 84 may include functionality for receiver adaptive processing, weight generation or beam selection, maximum ratio combining, or the like.

Figure 4:
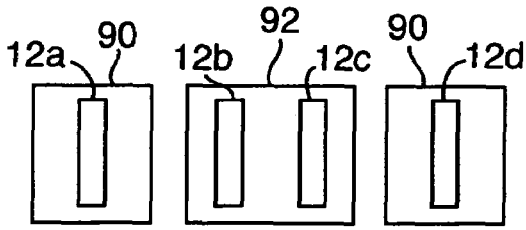
FIGS. 4 and 8 are schematic views of the antenna array system.

As should be appreciated, although the antenna array 10 will typically have at least four antenna columns 12*a*-12*d*, more antenna columns may be used for certain applications. Accordingly, as shown in FIG. 4, the array system 10 may be characterized as including a first group 90 of antenna columns and a second group 92 of antenna columns. Each group 90, 92 includes two or more antenna columns. All the antenna columns (e.g., in both groups collectively) are generally linearly arranged, with neighboring columns being spaced apart by the distance "D" as above. Thus, as can be seen, the first group 90 includes two or more outer antenna columns 12*a*, 12*d*, and the second group 92 includes the two or more inner antenna columns 12*b*, 12*c*. The antenna columns in one of the groups (e.g., with reference to the embodiment in FIG. 1, the second group 92) are dual-polarized antenna columns configured to operate at first and second polarizations. The antenna columns in the other group, e.g., the first group 90, are configured to operate at the first polarization only. Thus, even if there are more than four antenna columns, the antenna array may be used for beamformed transmissions over both groups at the first polarization and for diversity reception at the group with dual-polarized columns.

In using the antenna array 10, at least two steps are typically carried out from the system level perspective. The first step involves carrying out a beamforming operation on or in regards to a signal to be transmitted over the forward link 28. The beamforming operation utilizes the four antenna columns at the first polarization, e.g., columns 12*a*-12*d* with the arrays 20*a*-20*d*. The second step involves diversity processing of a signal received over the reverse link 30 at the dual-polarized columns 12*b*, 12*c* with the arrays 20*b*, 22*b*, 20*c*, 22*c*.

The antenna array 10 may be housed in a radome 94 or other weatherproof enclosure, for protecting the array from the elements. Also, the antenna groups 90, 92 may be housed together in a single radome or separately in two or more radomes.

Figure 5:
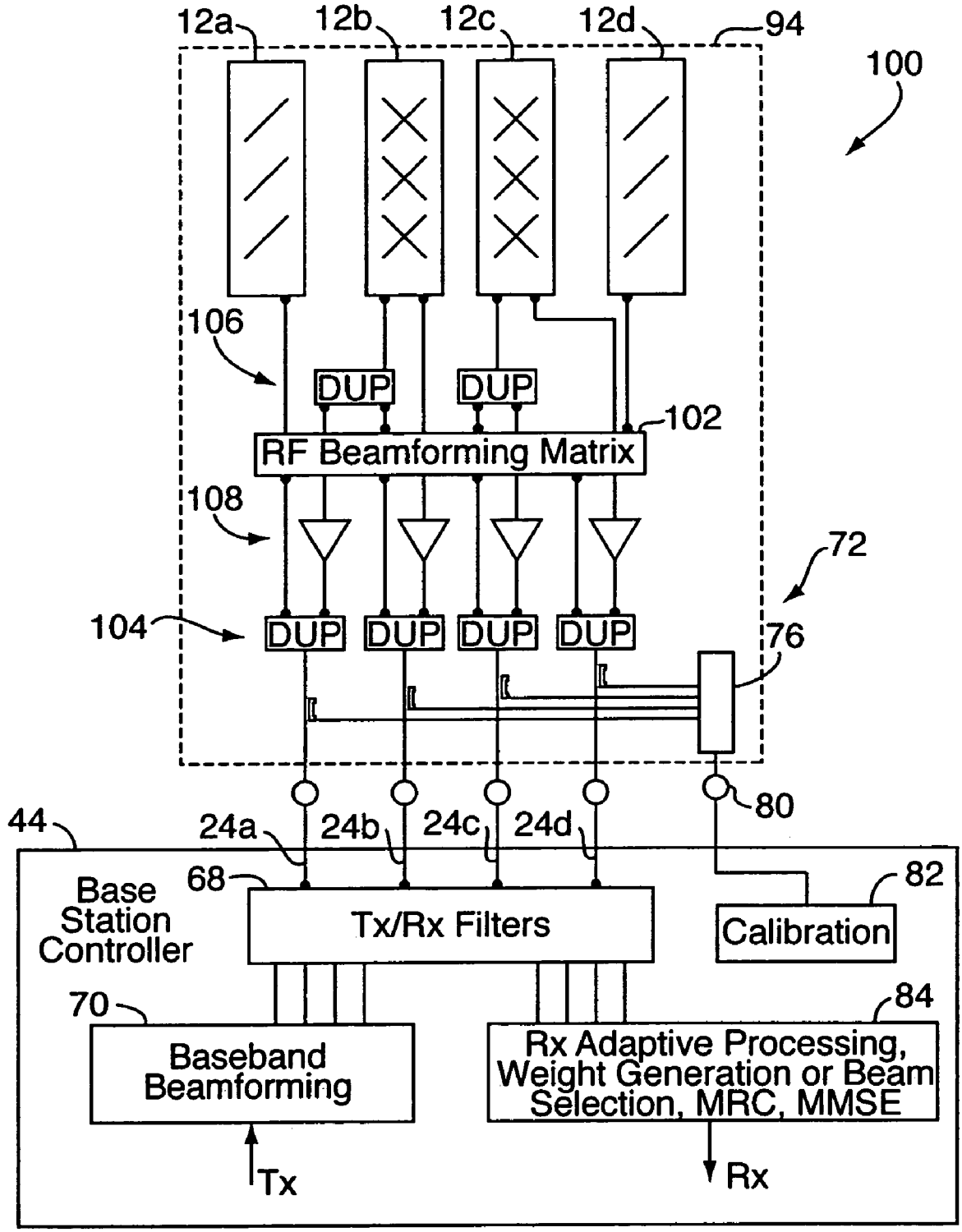
FIGS. 5-7 and 9-12 are schematic diagrams of additional embodiments of the antenna array system.

FIG. 5 shows an additional embodiment of an antenna array system 100, configured for carrying out fixed forward link beamforming at the RF level. For this, the antenna array 100 further includes a Butler or other standard RF-level beamforming matrix 102. The inputs of the matrix 102 are respectively connected to the transmission terminals of four duplexer circuits 104 ("DUP"), which are in turn connected to the RF feed cables 24*a*-24*d*. The outputs of the matrix 102 are connected to the four antenna columns 12*a*-12*d*. For the two dual-polarized center columns 12*b*, 12*c*, the connection is through two additional duplexer circuits 106. The antenna array 100 may further include tower-top low noise amplifiers (TTLNA) 108, e.g., as commonly used in UMTS systems. TTLNA units 108 are provided to amplify the low power signals received at an antenna, for compensating for loss introduced by the RF feed cables 24*a*-24*d* or otherwise. Typically, a TTLNA consists of two transmit/receive duplexers for splitting and then re-combining the signal, with a low noise amplifier on the receive branch and a bypass transmission line on the transmit branch. Here, duplexer units 104, 106 are already provided as part of the antenna array feed network, meaning that the TTLNA units 108 (provided as, e.g., low noise amplifier circuits) are connected to the center columns 12*b*, 12*c* in the received-signals pathways as shown in FIG. 5. In other words, a low noise amplifier circuit may be disposed along each conductor/cable that carries only a received signal, at some point between the antenna and RF feed cable.

Array systems that use baseband beamforming could also be outfitted with TTLNA units, such as the one shown in FIGS. 1 and 2. Here, since the duplexers 26*a*, 26*b* are already provided as part of the antenna feed network, it would be possible to interpose low noise amplifiers 110 in the receive paths (example shown in FIG. 2). On the other feeds (e.g., the ones carrying both transmit and received signals), TTLNA units 112, with two duplexers and a low noise amplifier in the received signal path between the duplexers, would be used.

Figure 6:
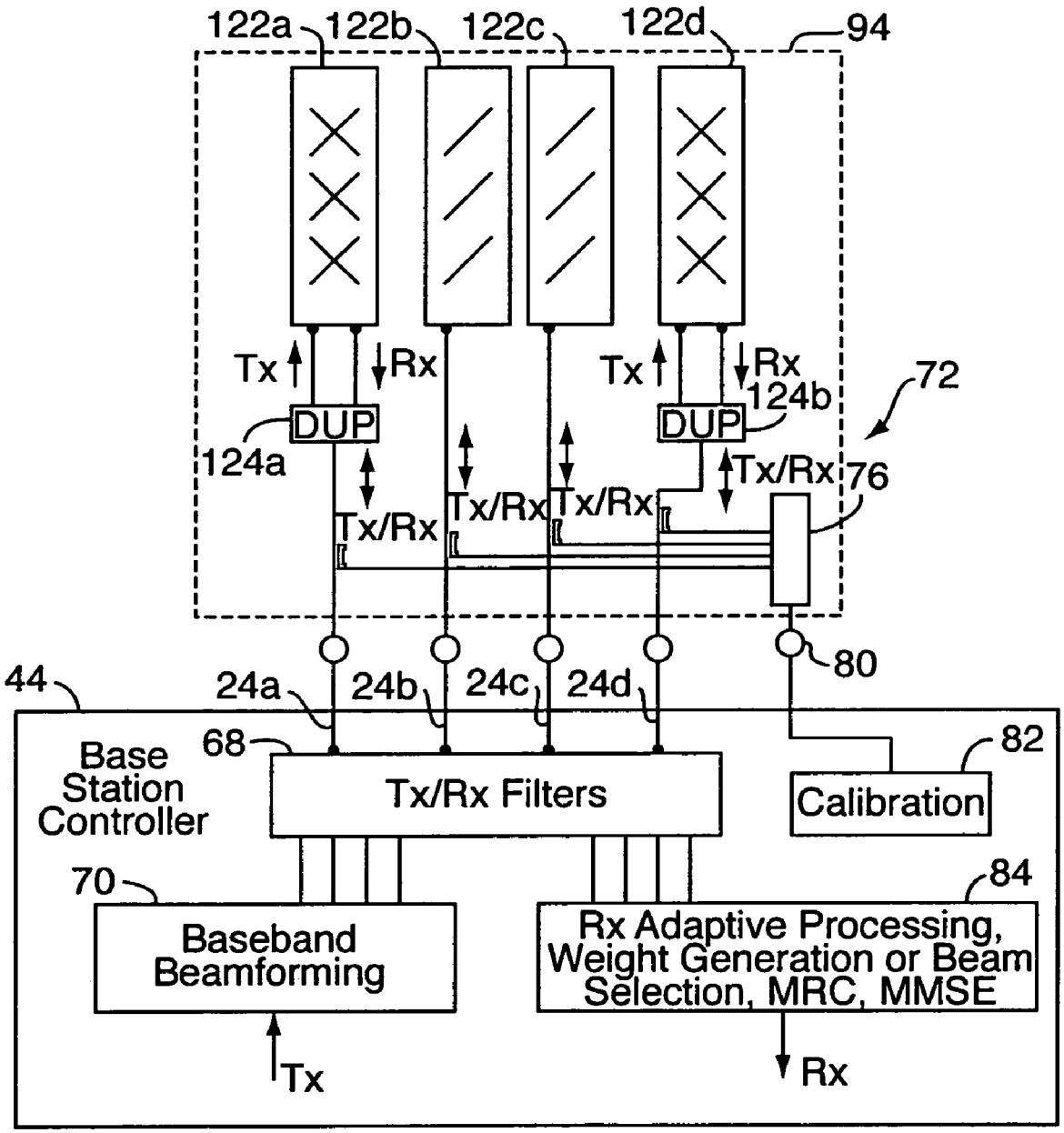

FIG. 6 shows an additional embodiment of an antenna array 120. The antenna array provides 4-branch diversity reception on the reverse link, and is also configured for use in deriving DOA information for beam steering or beam selection over the forward link. The array 120 includes two outer, dual-polarized antenna columns 122*a*, 122*d* and two inner, single-polarized columns 122*b*, 122*c*. The ports of the outer columns 122*a*, 122*d* are combined into a single RF feed line 24*a*, 24*d* by way of duplexers 124*a*, 124*b*, respectively. Thus, signals may be transmitted over all four antenna columns 122*a*-122*d* at a first polarization, and received at all four antenna columns, at the first polarization of the inner antenna columns 122*b*, 122*c* and the second polarization of the outer antenna columns 122*a*, 122*d*, as indicated in FIG. 6. The array 120 may be used to derive mobile direction information for use at the forward link from the signals at the two single-polarized inner columns 122*b*, 122*c*. The array 120 would be best suited for deriving DOA information for moving wireless units. If a wireless unit was stationary, it is possible that the signals one of the two orthogonal polarizations (e.g., the ones of the inner columns 122*b*, 122*c*) would be fading, possibly leading to a noisy estimate of DOA. In comparison, with the arrays 10 and 100 it is possible to derive DOA information from signals at both polarizations using an averaging technique, meaning that the DOA estimates would likely be more reliable.

Figure 7:
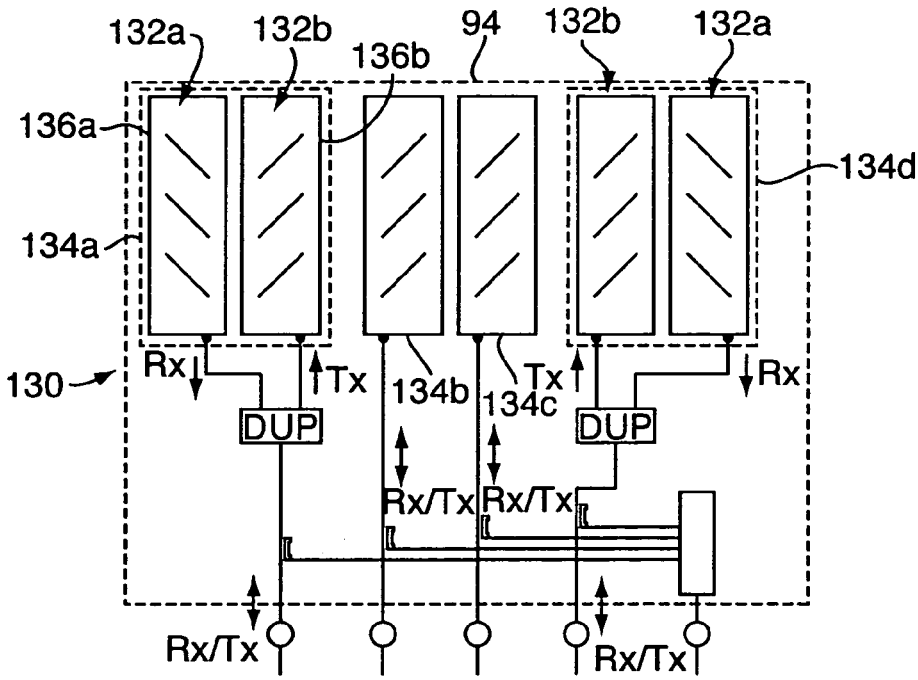

FIG. 7 shows an additional embodiment of the antenna array system. Here, an antenna array 130 is generally similar to the antenna array 120 shown in FIG. 6. However, the arrays 132*a*, 132*b* of radiating elements on the outer two antenna columns 134*a*, 134*d* are not co-located, e.g., they are spaced apart. The elements in the first array 132*a* are oriented at a first polarization. The elements in the second array 132*b* are oriented at a second polarization orthogonal to the first polarization. Slant 45° is shown, but other polarizations are possible. The radiating elements in the two inner columns 134*b*, 134*c* are oriented at the second polarization. The outer columns 134*a*, 134*d* may comprise single or integrated antenna columns with non co-located elements, or they may be separate columns 136*a*, 136*b*. In operation, transmissions over the forward link are made using the four inner arrays 132*b*, 134*b*, 134*c* at the second polarization. Diversity signal reception is at the innermost two columns 134*b*, 134*c* at the second polarization and at the outermost two arrays 132*a* at the first polarization. The innermost two columns 134*b*, 134*c* may also be used for estimating forward link signal direction. The antenna array 130 would provide enhanced spatial diversity, but possibly at the expense of a wider radome or radomes 94.

Figure 8:
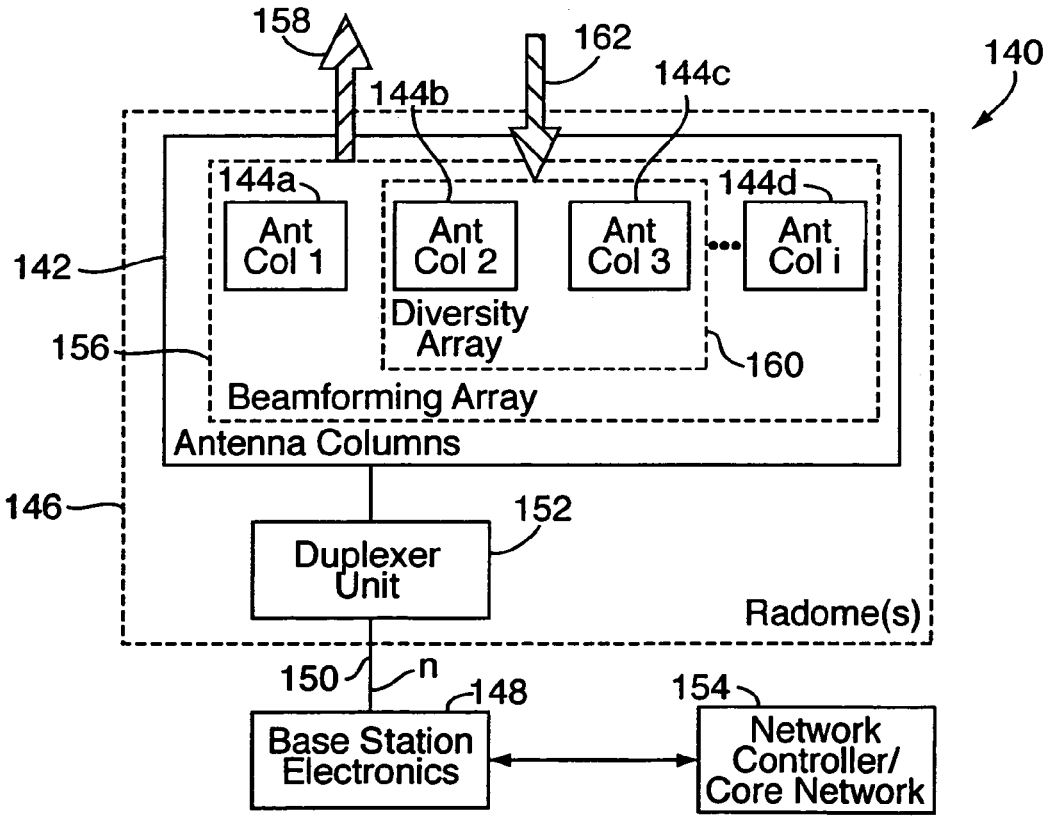

The antenna array systems described herein are shown in a schematic, more general or conceptual sense in FIG. 8. As indicated, the antenna array system 140 includes a plurality, grouping, or array 142 of antenna columns 144*a*-144*d*. The number of antenna columns provided may vary in different embodiments, depending on the operational configuration desired. Typically, there will be from 4 to "i" antenna columns, where "i" is a whole number greater than 4. Each antenna column includes at least one array of radiating elements; some of the antenna columns may have two arrays of radiating elements each oriented at a different polarization. The antenna columns are housed in one or more radomes 146. The antenna columns 142 are connected to the base station controller or other electronics 148 by way of "n" RF feed cables 150, where $n \geqq 1$ (and more typically n=4). One or more of the antenna columns 142 may be connected to one or more of the feed cables 150 by way of a duplexer unit 152, for minimizing the number of feed cables, e.g., typically four or less. The base station electronics 148 are in turn connected to a network controller and/or core landline network 154. Two or more of the antenna columns form a beamforming array or group 156 for transmissions over the forward link (downlink) 158. Two or more of the antenna columns also form a diversity array or group 160 for diversity reception of signals across the reverse link (uplink) 162. One or more of the antenna columns may be coextensive in each array 156, 160, e.g., at least a portion of the same antenna column is used in both arrays. Thus, as noted above, the antenna array system 140 provides an array for forward link beamforming and an array for reverse link diversity reception simultaneously.

Figure 9:
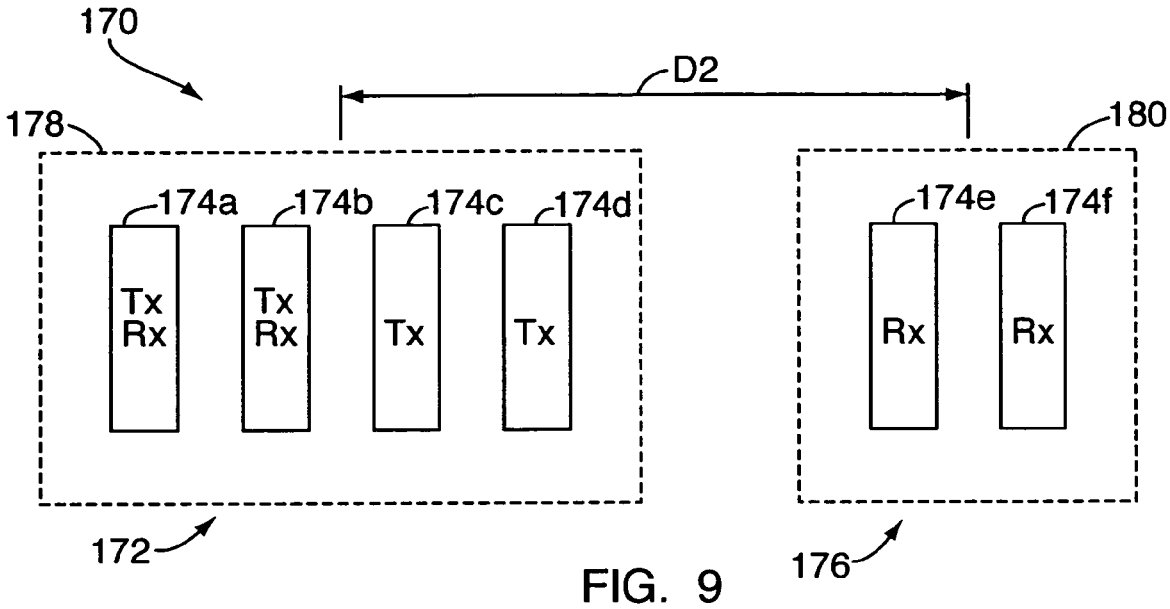

FIG. 9 shows an embodiment of an antenna array system 170 adapted for spatial diversity reception. The system 170 generally falls within the purview of the antenna arrays described above with respect to FIGS. 4 and 8, e.g., a set of linearly arranged antenna columns simultaneously providing a beamforming array for transmissions across the forward link and a diversity array for reception on the reverse link. Here, as noted, instead of polarization diversity, the array system 170 is configured for spatial diversity reception. In particular, the antenna system 170 includes a first group 172 of four antenna columns 174*a*-174*d* and a second group 176 of two antenna columns 174*e*, 174*f*. The antenna columns in the groups 172, 176 may be housed in separate radomes 178, 180, respectively, or the same radome. The antenna groups 172, 176 are spaced apart as indicated by a distance "D2" of approximately 10λ. In operation, the antenna columns 174*e*, 174*f* in the second group 176 are used for signal reception ("Rx") only. The antenna columns 174*a*-174*d* in the first group 172 are used for signal transmission. Additionally, any two adjacent antenna columns in the first group 172, e.g., antenna columns 174*a*, 174*b*, are used for both transmission ("Tx") and reception. As should be appreciated, since the antenna columns 174*e*, 174*f* in the second group 176 are significantly spaced apart from the reception antenna columns 174*a*, 174*b* in the first group 172, this provides an antenna array especially adapted for spatial diversity reception.

Figure 10:
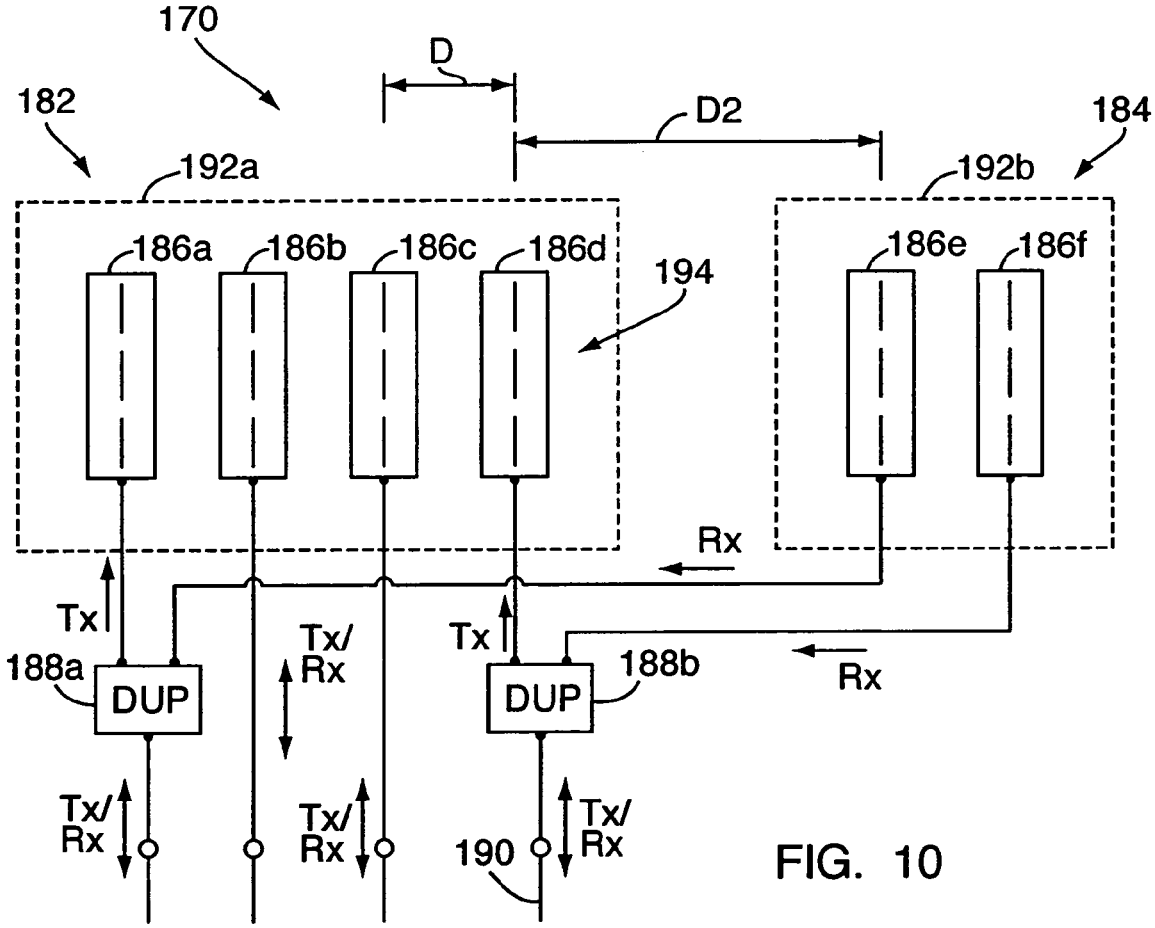

A more specific example of the antenna system 170 is shown in FIG. 10. The antenna system 170 functions in a manner similar to the array system 10 shown in FIG. 1, but with spatial diversity instead of polarization diversity. The antenna array system 170 includes a 4-column beamforming array 182 and a 2-column spatial diversity reception array 184. The beamforming array 182 has four antenna columns 186*a*-186*d* of co-polarized elements, e.g., the antenna elements are at the same polarization. The array 184 has two antenna columns 186*e*, 186*f*. Neighboring antenna columns 186*a*-186*d*, 186*e*-186*f* in each array 182, 184, respectively, may be closely spaced apart by a distance "D" of approximately λ/2. The distance between the columns 186*e*, 186*f* of diversity array 184 may also be D=λ/2, but it may be larger, depending on the application. For example, in a spatial diversity configuration that would correspond to the configuration shown in FIGS. 6 or 7, the distance between antenna columns in the diversity array would typically be larger. The beamforming array 182 is spaced apart from the diversity array 184 by a significant distance "D2" of approximately 10λ-20λ. Distance D2 is chosen to be adapted for required diversity performance in the particular deployment environment. Distance D2 is a function of the environment, and in particular the multipath angle spread. In a rural or suburban environment, the angle spread is small, resulting in a distance D2 of typically 10λ-20λ. In other environments the required distance may be smaller.

In operation, as indicated in FIG. 10, the four antenna columns 186*a*-186*d* are used for beamformed transmissions over the forward link. The two antenna columns 186*e*, 186*f* in the diversity array 184 are used for receiving signals over the reverse link. In addition, any two adjacent antenna columns 186*a*-186*d* in the beamforming array 182 are also used for receiving signals over the reverse link. For example, in FIG. 10 the center antenna columns 186*b*, 186*c* are used for signal reception. Duplexers 188*a*, 188*b* may be used for combining the signals on respective pairs of transmission-only and reception-only antenna columns, for reducing the number of RF feed cables 190 required for routing signals from the base station electronics to the antenna arrays 182, 184. The antenna arrays 182, 184 may optionally be housed in separate radomes 192*a*, 192*b*, respectively, or in the same radome.

Additionally, for forward link beamforming the antenna array system 170 would be provided with a calibration system as described above with respect to FIG. 1, e.g., one directional coupler for each antenna column output, not shown here for clarity of illustration.

The antenna columns 186*a*-186*f* in FIG. 10 are shown as having a vertical polarization. The antenna elements 194 can be vertically polarized dipoles (schematically shown), patches, log-periodic, or other types of radiating elements as known in the art. Typically, the four columns 186*a*-186*d* of the beamforming array 182 will be co-polarized. Additionally, the antenna columns 186*e*, 186*f* of the diversity array 184 will typically be co-polarized if they are to be used to derive DOA information. For example, all six of the antenna columns 186*a*-186*f* may be +45° slant polarized, or the antenna columns 186*a*-186*d* in the beamforming array 182 may be +45° slant polarized and the antenna columns 186*e*, 186*f* in the diversity array 184 may be −45° slant polarized, or the like.

Figure 11:
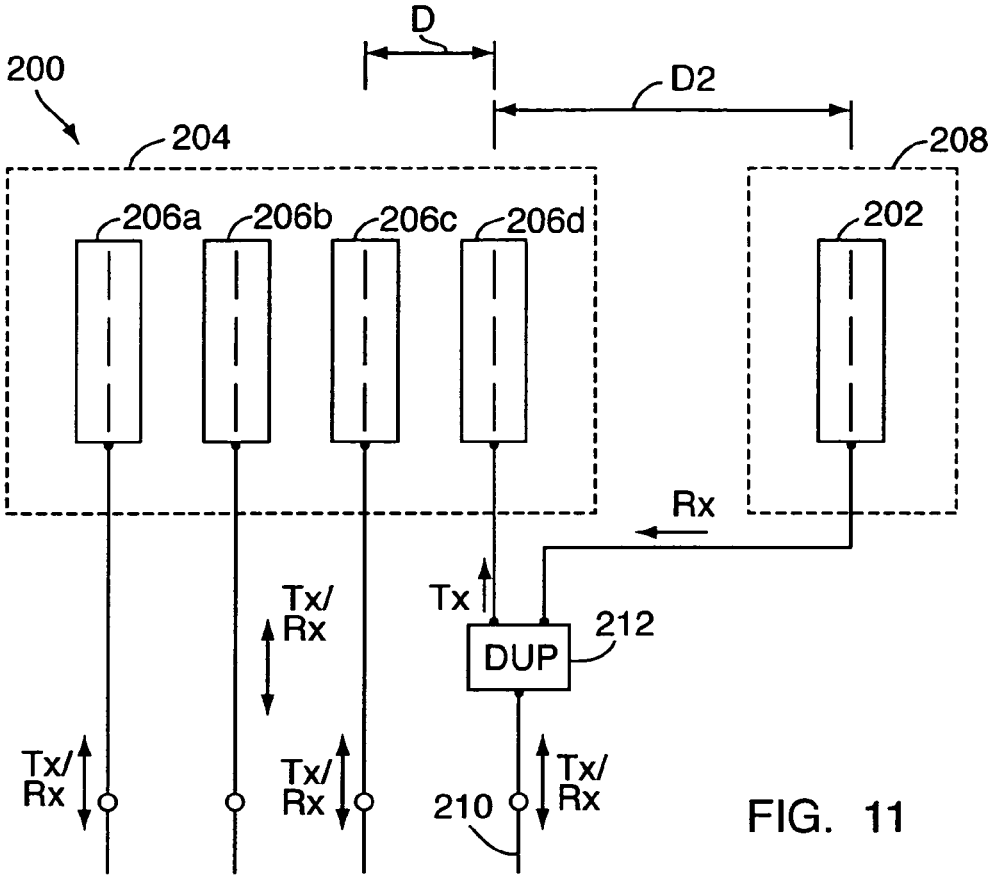

FIG. 11 shows another example of an antenna array system 200 configured for spatial diversity reception. The array system 200 is generally similar to the system 170 in FIG. 10, but only one antenna column 202 is provided or reconfigured for spatial diversity. Thus, the antenna array system 200 includes a beamforming array 204 having four antenna columns 206*a*-206*d* and a diversity array 208 having the single diversity column 202. Antenna column 206*d* is used for transmission only, and the diversity column 202 is used for signal reception only, as indicated. The two columns 206*d*, 202 are connected to a common feed cable 210 by a duplexer 212. The other columns 206*a*-206*c* in the beamforming array 204 are used for both transmission and reception. (Note that the calibration network is not shown in FIG. 11; however, a calibration network would typically be provided as described above.)

Figure 12:
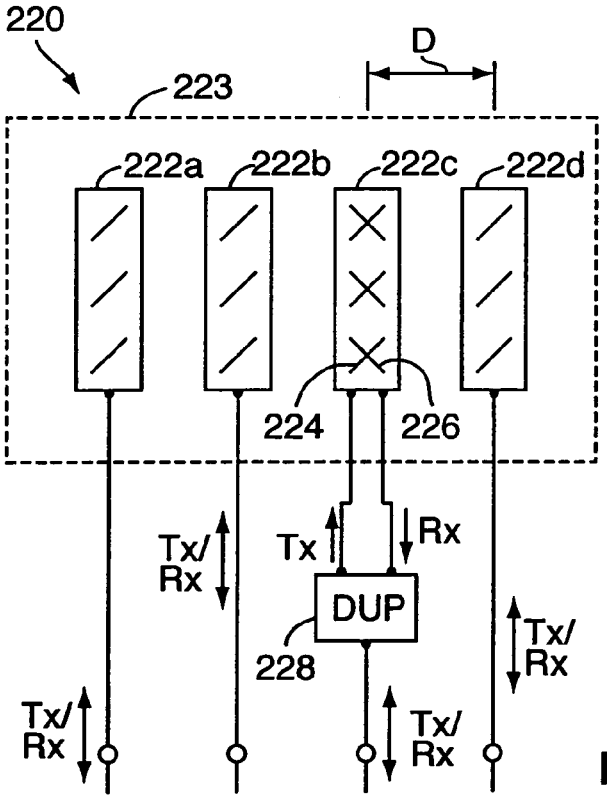

Instead of (or in addition to) spatial diversity reception, a "single diversity column" array system (as in FIG. 11) can be configured for polarization diversity. An example is shown in FIG. 12. There, an antenna array system 220 includes four antenna columns 222*a*-222*d* housed in a radome 223 or the like. Three of the antenna columns 222*a*, 222*b*, 222*d* include antenna elements oriented at a first polarization (here, slant 45°), which are used for both transmission and reception. One of the antenna columns 222*c* includes a first array of antenna elements 224 at the first polarization and a second array of co-located antenna elements 226 at a second polarization. The antenna elements 224 are used for transmission, and the antenna elements 226 are used for reception. The ports of the column 222*c* are attached to a duplexer 228. As should be appreciated, the antenna array system 220 provides a four-column, single-polarized antenna array for forward link beamforming and a four-column array (with one dual-polarized column) for reverse link diversity reception simultaneously. The diversity column 222*c* may be co-located, as shown in FIG. 12, or it may be separated from the other columns by a desired distance.

Although the duplexer unit has been showing as reducing the number of feed cable outlets to four, it should be appreciated that there may be more than four feed cable outlets in situations where the first group of antennas (e.g., the beamforming array) has more than four antennas. For example, if the antenna array system is configured for use in covering a plurality of sectors, the first group could have a number of antennas, e.g., 12 antennas, arranged circularly. In such a case, duplexers could be used to reduce the number of feed cable outlets to no more than the number of antennas in the first group.

Since certain changes may be made in the above-described antenna array system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. An antenna array system comprising:

a plurality of spaced-apart antennas; and at least one duplexer unit connected to at least one of said antennas, wherein a first group of said antennas is configured for transmission beamforming over a first bandwidth, a second group of said antennas is configured for simultaneous diversity reception over a second bandwidth, and said at least one duplexer unit is configured to combine a transmission signal of said first group and a reception signal of said second group.

2. The system of claim 1 wherein the plurality of antennas are arranged in a selected one of a generally linear manner and a generally circular manner, and wherein at least the antennas in the first group are spaced apart from one another by about one-half of a free-space wavelength of a designated carrier frequency.

3. The system of claim 1 wherein said plurality of antennas and said at least one duplexer unit are interconnected to provide a plurality of feed cable outlets for connecting the antenna array system to a base station unit, wherein the number of feed cable outlets does not exceed the number of antennas in the first group.

4. The system of claim 1 wherein:

the second group of antennas comprises first and second sub-arrays each having at least one of said plurality of antennas, said first and second sub-arrays being spaced apart from one another by a distance adapted for spatial diversity reception of signals over the second bandwidth, wherein the first sub-array is co-extensive with the first group.

5. The system of claim 4 wherein:

the first group comprises four of said plurality of antennas, each having an array of antenna elements oriented at a first polarization; and the second group comprises four of said plurality of antennas, each having an array of antenna elements oriented at the first polarization, wherein the first sub-array includes at least two antennas and the second sub-array includes at least one antenna.

6. The system of claim 4 wherein:

the first group and the first sub-array are housed in a first radome; and the second sub-array is housed in a second radome.

7. The system of claim 1 wherein:

each antenna in the first group includes an array of radiating elements oriented at a first polarization; and each of at least two antennas in the second group includes an array of radiating elements oriented at the first polarization, and at least one of the antennas in the second group includes an array of radiating elements oriented at a second polarization, wherein the second group is configured for polarization diversity reception over the second bandwidth.

8. The system of claim 7 wherein:

the plurality of antennas comprises two inner antennas and two outer antennas, wherein a selected one of the two inner antennas and the two outer antennas are each dual-polarized antennas.

9. The system of claim 8 wherein the antennas and the at least one duplexer unit are interconnected to provide: a four column antenna array at the first polarization for signal transmission; a two column dual-polarized antenna array at the first polarization and the second polarization for diversity reception; and no more than four feed cable outlets for connecting the antenna array system to a base station unit.

10. The system of claim 1 further comprising:

at least one beamforming circuit operably interfaced with at least one of said at least one duplexer unit and said plurality of antennas for implementing beamformed transmissions over the first group.

11. The system of claim 10 further comprising:

a calibration network operably connected to at least the antennas in the first group for calibration of beamformed transmissions.

12. The system of claim 11 wherein the beamforming circuit is a baseband beamforming circuit operably operably interfaced with feed cable outlets of the first and second groups.

13. The system of claim 11 wherein the beamforming circuit is a radio-frequency beamforming circuit connected to the at least one duplexer unit and at least one of said plurality of antennas.

14. An antenna array system comprising:

an antenna array comprising a plurality of spaced apart antennas, each of said antennas including at least one antenna element oriented at a first polarization for transmission beamforming over a first bandwidth, wherein at least two of the antennas are diversity antennas configured for simultaneous diversity reception over a second bandwidth; and at least one duplexer unit connected to the antenna array for combining transmission and reception signals of at least one of said antennas.

15. The system of claim 14 wherein:

the plurality of antennas in the antenna array are spaced apart from one another by about one-half of a free-space wavelength of a designated carrier frequency; and the system further comprises at least one spatial diversity antenna spaced apart from the array by a distance adapted for spatial diversity reception of signals over the second bandwidth, in conjunction with said diversity antennas.

16. The system of claim 14 wherein:

the plurality of antennas in the antenna array are spaced apart from one another by about one-half of a free-space wavelength of a designated carrier frequency; and each of said diversity antennas comprises a dual-polarized antenna having said at least one antenna element oriented at the first polarization and at least one antenna element oriented at a second polarization, for polarization diversity reception of signals.

17. The system of claim 16 wherein:

the antenna array comprises two inner antennas and two outer antennas; and a selected one of the two inner antennas and the two outer antennas are the dual-polarized antennas.

18. The system of claim 14 wherein the array and said at least one duplexer unit are interconnected to provide a plurality of feed cable outlets for connecting the array to a base station unit, wherein the number of feed cable outlets is no more than the number of antennas in the antenna array.

19. A method for wireless communications over a network having forward and reverse links, said method comprising the steps of:

beamforming at least one forward link signal over one or more antennas in a first group of spaced-apart antennas;

diversity processing at least one reverse link signal received at one or more antennas in a second group of spaced-apart antennas, said second group being at least partly co-extensive with the first group; and combining said forward link signal and said reverse link signal using a duplexer unit.

* * * * *